US011830417B2

(12) United States Patent
Im et al.

(10) Patent No.: US 11,830,417 B2
(45) Date of Patent: Nov. 28, 2023

(54) DISPLAY DEVICE

(71) Applicant: Samsung Display Co., LTD., Yongin-si (KR)

(72) Inventors: Tae Gon Im, Yongin-si (KR); Jong Jae Lee, Yongin-si (KR); Dae Gwang Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/965,576

(22) Filed: Oct. 13, 2022

(65) Prior Publication Data

US 2023/0121344 A1 Apr. 20, 2023

(30) Foreign Application Priority Data

Oct. 18, 2021 (KR) ..... 10-2021-0138707

(51) Int. Cl.
*G09G 3/32* (2016.01)

(52) U.S. Cl.
CPC ..... *G09G 3/32* (2013.01); *G09G 2310/027* (2013.01); *G09G 2310/0262* (2013.01); *G09G 2310/0286* (2013.01); *G09G 2310/0291* (2013.01); *G09G 2310/08* (2013.01)

(58) Field of Classification Search
CPC ..... G09G 3/32; G09G 2310/0262; G09G 2310/027; G09G 2310/0286; G09G 2310/0291; G09G 2310/08
See application file for complete search history.

(56) References Cited

U.S. PATENT DOCUMENTS

| | | | | |
|---|---|---|---|---|
| 8,248,398 | B2 | 8/2012 | Cho et al. | |
| 2010/0164847 | A1* | 7/2010 | Lee | G09G 3/3233 345/77 |
| 2015/0179107 | A1* | 6/2015 | Kim | G09G 3/3233 345/82 |
| 2015/0187276 | A1* | 7/2015 | Shim | G09G 3/3291 345/77 |
| 2017/0031485 | A1* | 2/2017 | Kim | G06F 3/04184 |
| 2018/0174518 | A1* | 6/2018 | Suk | G09G 3/3291 |

FOREIGN PATENT DOCUMENTS

| | | | |
|---|---|---|---|
| KR | 10-1319339 | B1 | 10/2013 |
| KR | 10-2017-0018196 | A | 2/2017 |
| KR | 10-2017-0081046 | A | 7/2017 |
| KR | 10-2122541 | B1 | 6/2020 |

* cited by examiner

*Primary Examiner* — Sanghyuk Park
(74) *Attorney, Agent, or Firm* — Lewis Roca Rothgerber Christie LLP

(57) ABSTRACT

A display device includes: a pixel unit including a plurality of pixels; a data driver configured to supply a data voltage to the pixels through data lines based on a source output enable signal; and a reference voltage controller configured to supply a reference voltage to the pixels through reference voltage lines, wherein each of the pixels includes a light emitting element between a first power source line and a second power source line, and wherein the reference voltage controller is configured to compensate for the reference voltage based on the source output enable signal, and to supply a compensated reference voltage to an anode electrode of the light emitting element.

20 Claims, 11 Drawing Sheets

DISPLAY DEVICE

CROSS-REFERENCE TO RELATED APPLICATION

The present application claims priority to and the benefit of Korean Patent Application No. 10-2021-0138707, filed on Oct. 18, 2021, the entire disclosure of which is incorporated herein by reference herein.

BACKGROUND

1. Field

Aspects of some embodiments of the present invention relate to a display device.

2. Discussion of the Related Art

With the development of information technology, the importance of display devices, which provide a connection medium between users and information, has been emphasized. In response to this, the use of display devices such as a liquid crystal display device, an organic light emitting display device, and the like has been increasing.

Such a display device may include a pixel unit including a plurality of pixels, and a scan driver, a data driver, and a timing controller for driving the pixel unit. Each of the pixels may include a light emitting element and a pixel circuit.

A data line to which a data voltage is supplied, a first power source line for supplying a first power source voltage, a second power source line for supplying a second power source voltage, a reference voltage line for supplying a reference voltage (or an initialization voltage) to an anode electrode of the light emitting element, and the like may be arranged in the pixel unit.

In this case, a voltage level of the reference voltage supplied through the reference voltage line may be changed by coupling with the data voltage supplied through the data line. When the reference voltage is fed back for compensation, because the compensation is performed with a delay, a ripple component may remain between the time when the voltage level of the reference voltage is changed and the time when the compensation is performed. As a result, a problem in which a desired gray level cannot be accurately expressed may occur.

The above information disclosed in this Background section is only for enhancement of understanding of the background and therefore the information discussed in this Background section does not necessarily constitute prior art.

SUMMARY

According to some embodiments, a display device may be capable of accurately expressing a desired gray level by compensating a reference voltage so that ripples do not occur or are reduced in magnitude or frequency.

According to some embodiments, a display device may include a pixel unit including a plurality of pixels, a data driver supplying a data voltage to the pixels through data lines based on a source output enable signal, and a reference voltage controller supplying a reference voltage to the pixels through reference voltage lines.

According to some embodiments, each of the pixels may include a light emitting element located between a first power source line and a second power source line, and the reference voltage controller may compensate for the reference voltage based on the source output enable signal, and supplies a compensated reference voltage to an anode electrode of the light emitting element.

According to some embodiments, the data driver may supply the data voltage to the pixels in synchronization with a rising edge of the source output enable signal, and the reference voltage controller may compensate the reference voltage in synchronization with the rising edge of the source output enable signal.

According to some embodiments, the data lines and the reference voltage lines connected to the same pixel among the pixels may extend in a first direction on the pixel unit and may be adjacent to each other in a second direction crossing the first direction.

According to some embodiments, a voltage level of the reference voltage may be changed in response to an image data voltage in a period in which the data voltage is changed from a data voltage corresponding to a peak black gray level to the image data voltage having a predetermined gray level value.

According to some embodiments, the reference voltage controller may compensate the compensated reference voltage to have a voltage level that offsets a changed voltage level of the reference voltage.

According to some embodiments, the display device may further include a timing controller supplying a source sampling clock, a source start pulse, and the source output enable signal to the data driver based on image data and timing signals output from a host system.

According to some embodiments, the display device may further include an image pattern analyzer supplying a mode conversion signal to the timing controller when a predetermined specific image pattern is detected by analyzing the image data.

According to some embodiments, the specific image pattern may be an image in which a peak white gray level is displayed on odd-numbered lines and the peak black gray level is displayed on even-numbered lines.

According to some embodiments, the data driver may include a shift register receiving the source sampling clock and the source start pulse from the timing controller and sequentially outputting a plurality of sampling pulses; a sampling latch sequentially storing the image data in response to the sampling pulses sequentially supplied from the shift register; and a holding latch receiving and storing the image data from the sampling latch when receiving the source output enable signal.

According to some embodiments, the display device may further include a decoder converting the image data from the holding latch into an analog signal and generating a converted analog signal as the data voltage; and a buffer amplifier supplying the data voltage received from the decoder to a data line.

According to some embodiments, the reference voltage controller may be a buck DC-DC converter including a PWM circuit connected to a gate electrode of at least one transistor, and the PWM circuit may output a PWM signal in synchronization with the rising edge of the source output enable signal.

According to some embodiments, a duty ratio of the PWM signal may be set so that the compensated reference voltage has the voltage level that offsets the changed voltage level of the reference voltage.

According to some embodiments, the reference voltage controller may calculate the compensated reference voltage based on a lookup table including the duty ratio of the PWM signal corresponding to image data voltages according to a plurality of gray level values.

According to some embodiments, the duty ratio of the PWM signal may gradually decrease from the duty ratio of the PWM signal corresponding to the image data voltage according to a low gray level to the duty ratio of the PWM signal corresponding to the image data voltage according to a high gray level.

According to some embodiments, the reference voltage controller may be a buffer circuit including an amplifier, an adder, and a switch. An inverting terminal of the amplifier may be connected to an output terminal, and a non-inverting terminal of the amplifier may be connected to the adder. The adder may be connected to a reference voltage supply unit supplying the reference voltage and a compensation voltage supply unit supplying a compensation voltage. The switch may be connected between the adder and the compensation voltage supply unit. The switch may be turned on in synchronization with the rising edge of the source output enable signal.

According to some embodiments, the compensation voltage may be set so that the compensated reference voltage has the voltage level that offsets the changed voltage level of the reference voltage.

According to some embodiments, the reference voltage controller may calculate the compensated reference voltage based on a lookup table including the compensation voltage corresponding to image data voltages according to a plurality of gray level values.

According to some embodiments, an absolute value of the compensation voltage may gradually increase from the compensation voltage corresponding to the image data voltage according to a low gray level to the compensation voltage corresponding to the image data voltage according to a high gray level.

According to some embodiments, the display device may further include a scan driver receiving gate control signals from the timing controller and supplying scan signals to first scan lines and second scan lines in the pixel unit.

According to some embodiments, each of the pixels may include a first transistor including one electrode connected to the first power source line, a gate electrode connected to a first node, and the other electrode connected to a second node; a second transistor including one electrode connected to the data line, the other electrode connected to the first node, and a gate electrode connected to a first scan line; a third transistor including one electrode connected to the second node, the other electrode connected to a reference voltage line, and a gate electrode connected to a second scan line; a storage capacitor connected between the first node and the second node; and the light emitting element connected between the second node and the second power source line.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain aspects of some embodiments of the present invention.

DETAILED DESCRIPTION

Figure 1A:
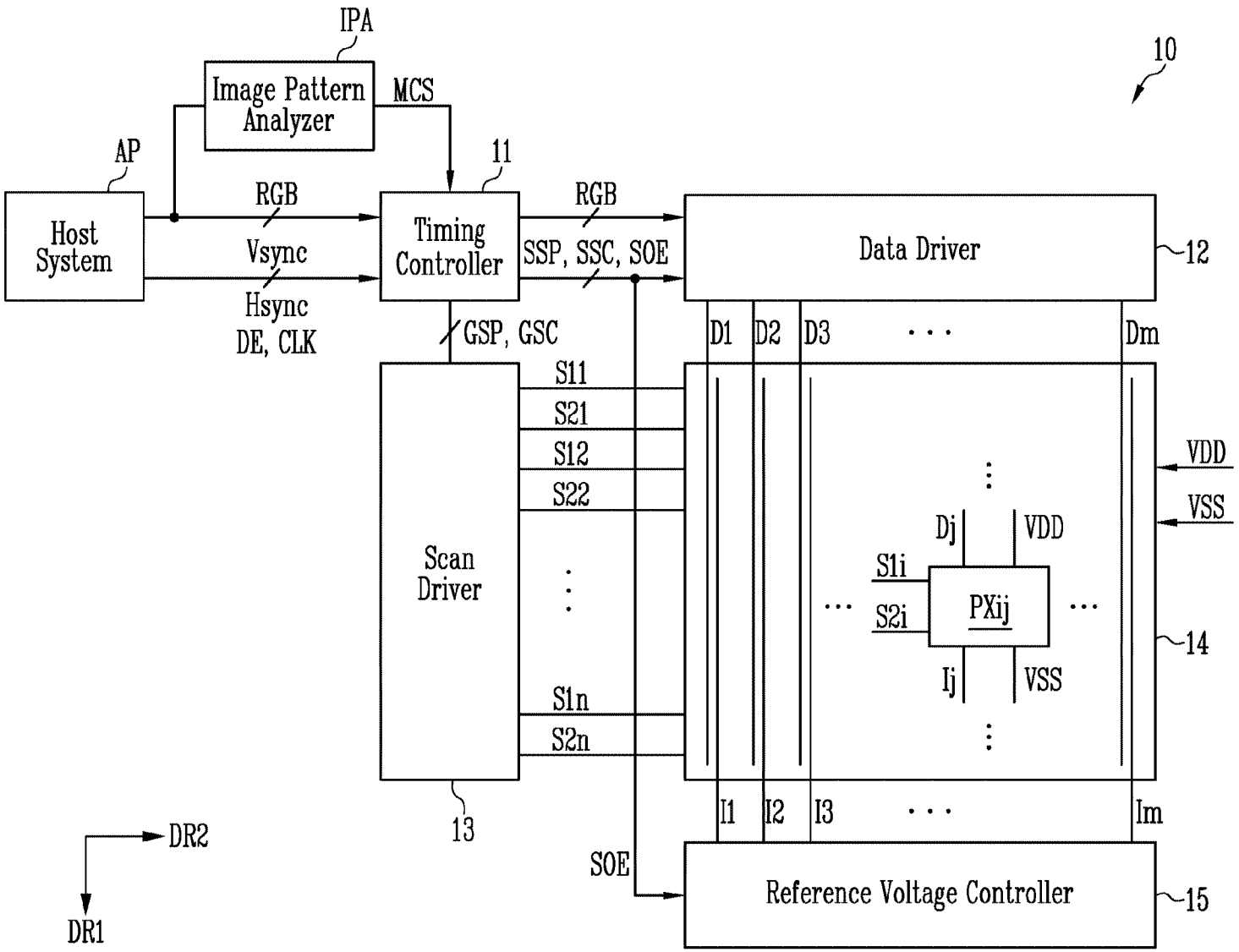
FIG. 1A is a diagram for explaining a display device according to some embodiments of the present invention.

Hereinafter, various embodiments of the present invention will be described in detail with reference to the accompanying drawings so that those of ordinary skill in the art may easily implement the present invention. The present invention may be embodied in various different forms and is not limited to the embodiments described herein.

In order to clearly describe the present invention, parts that are not related to the description may be omitted, and the same or similar components are denoted by the same reference numerals throughout the specification. Therefore, the reference numerals described above may also be used in other drawings.

In addition, the size and thickness of each component shown in the drawings are arbitrarily shown for convenience of description, and thus the present invention is not necessarily limited to those shown in the drawings. In the drawings, thicknesses may be exaggerated to clearly express the layers and regions.

Figure 1B:
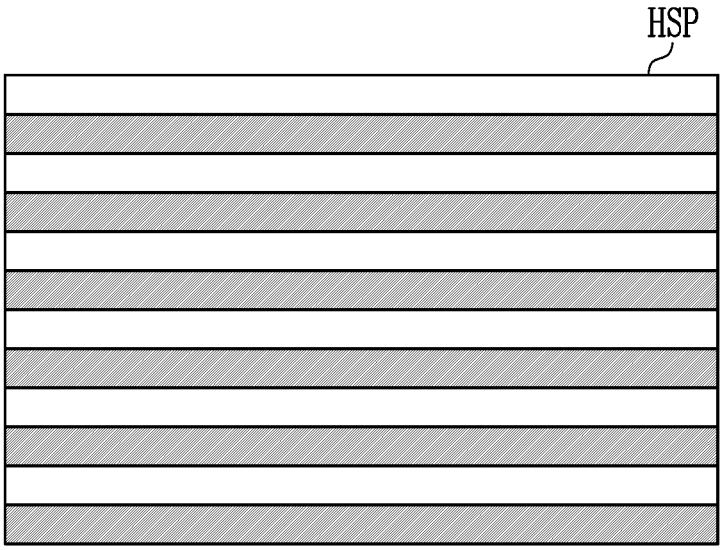
FIG. 1B is a diagram illustrating an example of a horizontal stripe pattern.

FIG. 1A is a diagram for explaining a display device according to some embodiments of the present invention. FIG. 1B is a diagram illustrating an example of a horizontal stripe pattern.

Referring to FIGS. 1A and 1B, a display device 10 according to some embodiments of the present invention may include an image pattern analyzer IPA, a timing controller 11, a data driver 12, a scan driver 13, a pixel unit 14, a reference voltage controller 15, and a host system AP.

The image pattern analyzer IPA may receive image data RGB output from the host system AP. When detecting a specific image pattern (e.g., a predetermined specific image pattern) by analyzing the image data RGB, the image pattern analyzer IPA may provide a mode conversion signal MCS and image pattern information to the timing controller 11. For example, according to some embodiments, the image pattern analyzer IPA may be configured to identify or detect certain images (e.g., predetermined specific image patterns) based on the image data RGB, and determine whether or not the image data RGB corresponds to the images. In response to identifying the image data RGB corresponds to an image (e.g., a predetermined specific image pattern), the image pattern analyzer IPA may generate or output a mode conversion signal along with information about the image that was identified to other components (e.g., the timing controller).

According to some embodiments, the specific image pattern may be a horizontal stripe pattern HSP. That is, the specific image pattern may mean an image displaying the same gray level in units of pixel rows. For example, the specific image pattern may be a black and white horizontal stripe pattern HSP shown in FIG. 1B. The black and white horizontal stripe pattern HSP may mean an image in which a peak white gray level is displayed on odd-numbered lines and a peak black gray level is displayed on even-numbered lines. In the case of the black and white horizontal stripe pattern, as a data voltage supplied to each of data lines, a peak white gray level voltage and a peak black gray level voltage should be alternately supplied every one horizontal period.

According to some embodiments, when detecting the horizontal stripe pattern HSP, the image pattern analyzer IPA may provide the mode conversion signal MCS to the timing controller 11. In this case, the display device 10 may operate in a first mode. Meanwhile, when the horizontal stripe pattern HSP is not detected, the image pattern analyzer IPA may not provide the mode conversion signal MCS to the timing controller 11. In this case, the display device 10 may operate in a second mode. For example, the first mode may be a visual test mode for examining the image quality of the display device 10, and the second mode may be a general display mode. Hereinafter, description will be made on the assumption that the display device 10 operates in the first mode.

Although the specific image pattern may be a horizontal stripe pattern HSP according to some embodiments, embodiments according to the present disclosure are not limited thereto, and the specific image pattern may be any suitable pattern according to the design of the display device 10.

Based on timing signals such as the image data RGB, a vertical synchronization signal Vsync, a horizontal synchronization signal Hsync, a data enable signal DE, and a clock signal CLK output from the host system AP, the timing controller 11 may supply a gate control signal to the scan driver 13 and supply a data control signal to the data driver 12. Also, the timing controller 11 may rearrange the image data RGB and supply it to the data driver 12.

The gate control signal may include a gate start pulse GSP, one or more gate shift clocks GSC, and the like. The gate start pulse GSP may control the timing of a first scan signal. The gate shift clock GSC may refer to one or more clock signals for shifting the gate start pulse GSP.

The data control signal may include a source start pulse SSP, a source sampling clock SSC, a source output enable signal SOE, and the like. The source start pulse SSP may control the timing at which data sampling starts in the data driver 12. The source sampling clock SSC may control a sampling operation of the data driver 12. The source output enable signal SOE may control the output timing of the data driver 12. The data driver 12 may generate data signals to be provided to data lines D1, D2, D3, . . . , and Dm using gray level values and control signals (for example, SSP, SSC, and SOE) received from the timing controller 11. In this case, m may be an integer greater than 0. For example, the data signals generated in units of pixel rows may be simultaneously (or concurrently) applied to the data lines D1, D2, D3, . . . , and Dm.

The scan driver 13 may receive gate control signals (for example, GSP and GSC) from the timing controller 11 to generate scan signals to be provided to first scan lines S11, S12, . . . , and Sin and second scan lines S21, S22, . . . , and S2*n*. In this case, n may be an integer greater than 0. For example, the scan driver 13 may select a pixel row in which the data signals are to be written by sequentially providing the scan signals of a turn-on level to the first scan lines S11, S12, . . . , and S1*n*.

The pixel unit 14 may include pixels. Each pixel PXij may be connected to corresponding data line Dj, first scan line S1*i*, second scan line S2*i*, and reference voltage line Ij. Also, each pixel PXij may be connected to a first power source line VDD and a second power source line VSS. For example, when the data signals are applied from the data driver 12 to the data lines D1, D2, D3, . . . , and Dm, the data signals may be written in a pixel row receiving a first scan signal of the turn-on level from the scan driver 13.

The reference voltage controller 15 may supply a reference voltage to reference voltage lines I1, I2, I3, . . . , and Im. In this case, a difference between the reference voltage and a voltage applied to the second power source line VSS may be lower than an emission threshold voltage of a light emitting element of each pixel PXij.

Meanwhile, as shown in FIG. 1A, the reference voltage lines I1, I2, I3, . . . , and Im and the data lines D1, D2, D3, . . . , and Dm may extend along a first direction DR1 on the pixel unit 14, and may be located adjacent to each other in the second direction DR2 crossing the first direction DR1. For this reason, in a period in which the data voltage (or data signal) is changed from a data voltage corresponding to the peak black gray level to a data voltage corresponding to the peak white gray level, a voltage level of the reference voltage may be changed (rising or falling) by coupling.

According to some embodiments of the present invention, the reference voltage controller 15 may compensate the changed voltage level of the reference voltage to a preset target voltage level and provide it to the pixel unit 14. The reference voltage controller 15 may receive the source output enable signal SOE and the image pattern information from the timing controller 11. Based on the source output enable signal SOE and the image pattern information, the reference voltage controller 15 may compensate for a change in the voltage level generated in the reference voltage by coupling. Hereinafter, a configuration for compensating the reference voltage will be described in detail with reference to FIGS. 5A to 8.

Figure 2:
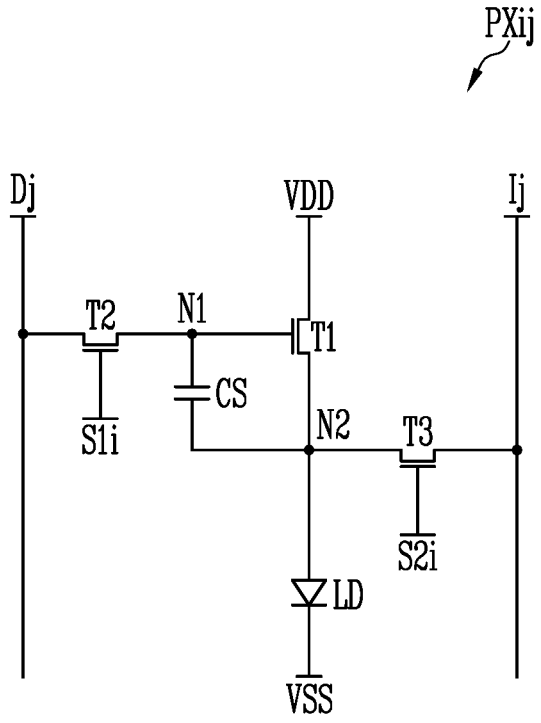
FIG. 2 is a diagram for explaining a pixel according to some embodiments of the present invention.

FIG. 2 is a diagram for explaining a pixel according to some embodiments of the present invention.

Referring to FIG. 2, the pixel PXij may include transistors T1, T2, and T3, a storage capacitor CS, and a light emitting element LD.

A first transistor T1 may have a gate electrode connected to a first node N1, one electrode connected to the first power source line VDD, and the other electrode connected to a second node N2. The first transistor T1 may be referred to as a driving transistor.

A second transistor T2 may have a gate electrode connected to the first scan line S1*i*, one electrode connected to the data line Dj, and the other electrode connected to the first node N1. The second transistor T2 may be referred to as a scan transistor, a switching transistor, or the like.

A third transistor T3 may have a gate electrode connected to the second scan line S2*i*, one electrode connected to the second node N2, and the other electrode connected to the reference voltage line Ij. The third transistor T3 may be referred to as an initialization transistor.

The storage capacitor CS may have one electrode connected to the first node N1 and the other electrode connected to the second node N2.

The light emitting element LD may have an anode connected to the second node N2 and a cathode connected to the second power source line VSS. According to some embodiments, the light emitting element LD may be an organic light emitting diode including an organic light emitting layer. According to some embodiments, the light emitting element LD may be an inorganic light emitting element formed of an inorganic material. According to some embodiments, the light emitting element LD may be a light emitting element composed of an inorganic material and an organic material in combination. The light emitting element LD may have a form in which a plurality of inorganic light emitting elements are connected in parallel and/or in series between the second power source line VSS and the second node N2. Here, i and j may be integers greater than 0. In FIG. 2, the transistors T1, T2, and T3 are configured as an N-type transistor, but embodiments according to the present invention are not limited thereto, and may be configured as a P-type transistor.

Figure 3:
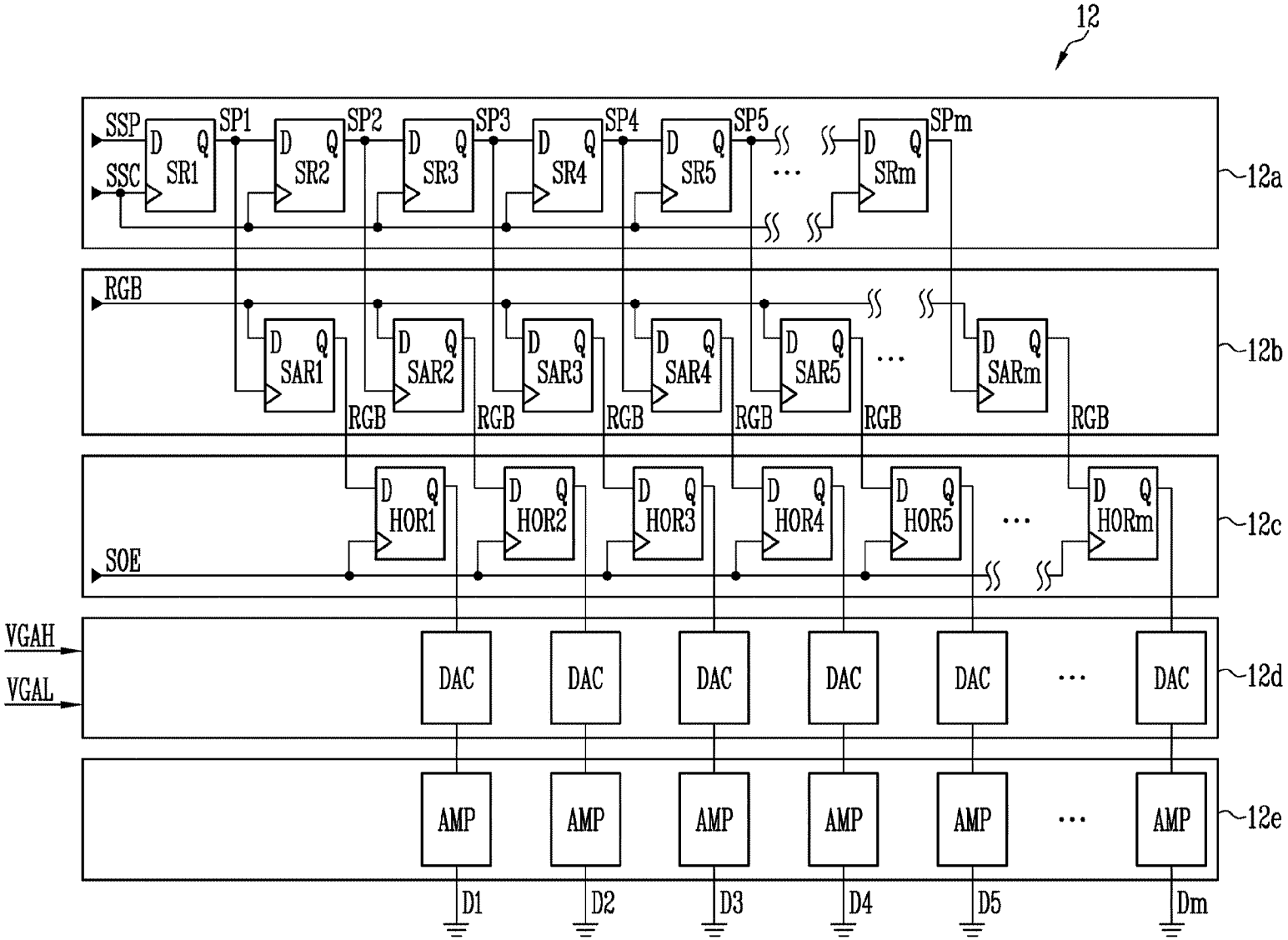
FIG. 3 is a diagram schematically illustrating aspects of a data driver of FIG. 1A according to some embodiments of the present invention.

FIG. 3 is a diagram schematically illustrating aspects of some embodiments of a data driver of FIG. 1A.

Referring to FIGS. 1A and 3, the data driver 12 according to some embodiments of the present invention may include a shift register 12*a*, a sampling latch 12*b*, and a holding latch 12*c*. Also, the data driver 12 may include a decoder 12*d* and a buffer amplifier 12*e* formed for each channel.

The shift register 12*a* may receive the source start pulse SSP and the source sampling clock SSC from the timing controller 11. The shift register 12*a* supplied with the source sampling clock SSC may sequentially generate a plurality of sampling pulses SP1, SP2, SP3, SP4, SP5, . . . , and SPm while shifting the source start pulse SSP for each period of the source sampling clock SSC. To this end, the shift register 12*a* may include a plurality of shift registers SR1, SR2, SR3, SR4, SR5, . . . , and SRm.

The sampling latch 12*b* may sequentially store the image data RGB in response to the sampling pulses SP1, SP2, SP3, SP4, SP5, . . . , and SPm sequentially supplied from the shift register 12*a*. For example, the sampling latch 12*b* may store the image data RGB corresponding to a plurality of channels in response to the sampling pulses SP1, SP2, SP3, SP4, SP5, . . . , and SPm. To this end, the sampling latch 12*b* may include a plurality of sampling latches SAR1, SAR2, SAR3, SAR4, SAR5, . . . , and SARm capable of storing the image data RGB corresponding to at least one channel.

The holding latch 12*c* may receive and store the image data RGB from the sampling latch 12*b* when the source output enable signal SOE is input. In addition, the holding latch 12*c* may supply the image data RGB stored therein to the decoder 12*d* located in each channel when the source output enable signal SOE is input. To this end, the holding latch 12*c* may include a plurality of holding latches HOR1, HOR2, HOR3, HOR4, HOR5, . . . , and HORm capable of storing the image data RGB corresponding to at least one channel for each channel.

The decoder 12*d* may convert the image data RGB output from the holding latch 12*c* into an analog signal, and output the converted analog signal as the data signal to the buffer amplifier 12*e*. The decoder 12*d* may select a plurality of gray level voltages from a minimum gray level gamma voltage VGAL and a maximum gray level gamma voltage VGAH based on the image data RGB output from the holding latch 12*c*. The decoder 12*d* may have m digital-to-analog converters DAC. That is, the decoder 12*d* may generate m data signals using the digital-to-analog converters DAC corresponding to each channel, and may supply the generated data signals to the buffer amplifier 12*e*.

The buffer amplifier 12*e* may supply the m data signals supplied from the decoder 12*d* tom data lines D1, D2, D3, D4, D5, . . . , and Dm. The buffer amplifier 12*e* may be implemented with m buffer amplifiers AMP.

Figure 4:
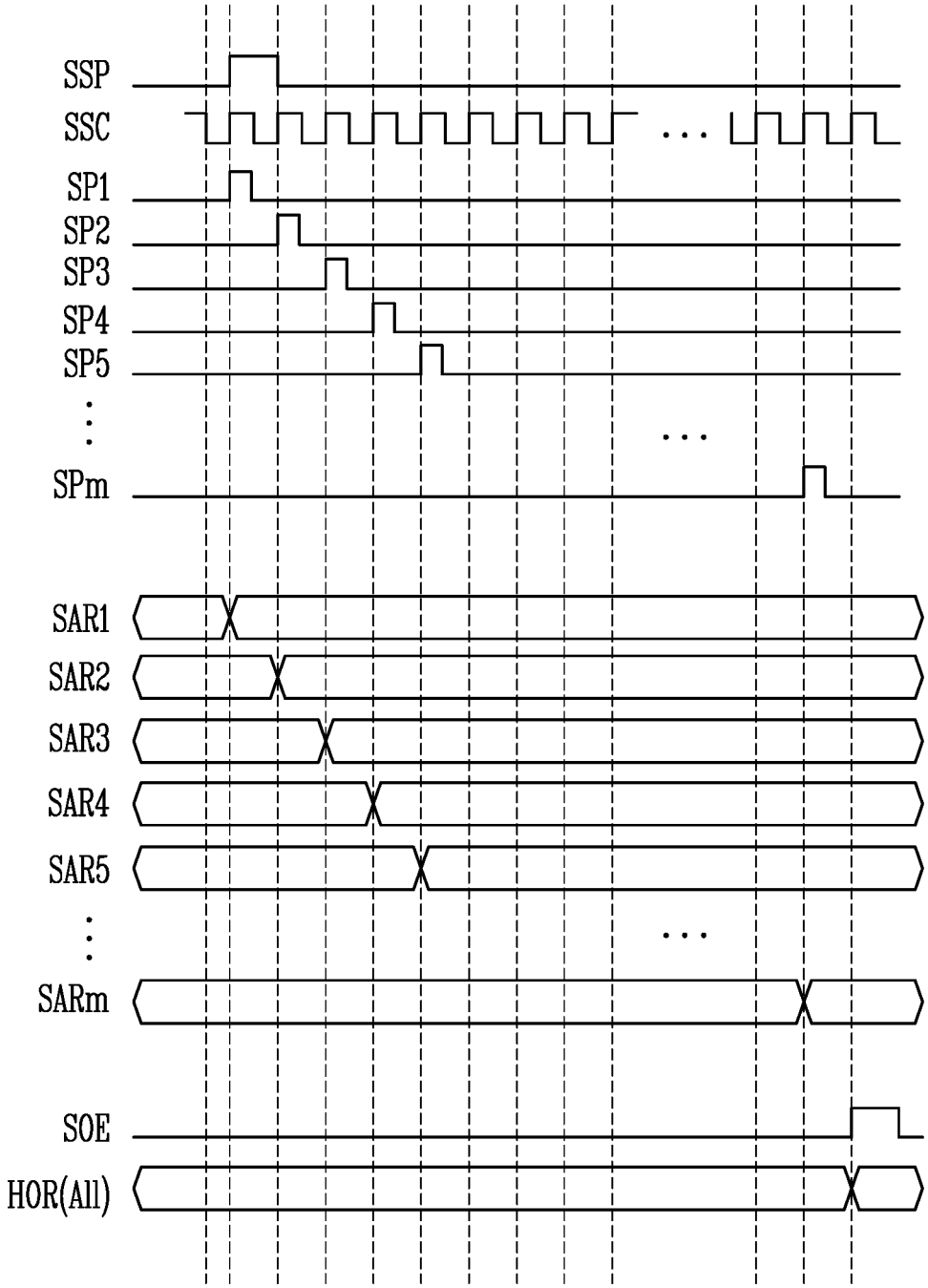
FIG. 4 is a waveform diagram illustrating an operation process of the data driver shown in FIG. 3.

FIG. 4 is a waveform diagram illustrating an operation process of the data driver shown in FIG. 3.

Referring to FIGS. 3 and 4, the shift registers SR1, SR2, SR3, SR4, SR5, and SRm may sequentially generate the sampling pulses SP1, SP2, SP3, SP4, SP5, . . . , and SPm corresponding to a high period of the source sampling clock SSC.

During a period in which the sampling pulses SP1, SP2, SP3, SP4, SP5, and SPm are supplied, the image data RGB to be stored in the sampling latches SAR1, SAR2, SAR3, SAR4, SAR5, . . . , and SARm may be input. For example, a first sampling latch SAR1 may store the image data RGB in synchronization with a rising edge of a first sampling pulse SP1. Thereafter, the image data RGB may be stored in second to m-th sampling latches SAR2, SAR3, SAR4, SAR5, . . . , and SARm even in second sampling pulse SP2 to m-th sampling pulse SPm through the same process. That is, data for each channel may be sequentially stored in the sampling latches SAR1, SAR2, SAR3, SAR4, SAR5, . . . , and SARm in response to the supply of the sampling pulses SP1, SP2, SP3, SP4, SP5, . . . , and SPm.

After desired image data RGB is stored in the sampling latches SAR1, SAR2, SAR3, SAR4, SAR5, . . . , and SARm, the source output enable signal SOE may be supplied. When the source output enable signal SOE is supplied, each of the holding latches HOR1, HOR2, HOR3, HOR4, HOR5, . . . , and HORm may receive the image data RGB stored in the sampling latches SAR1 to SARm.

Figure 5A:
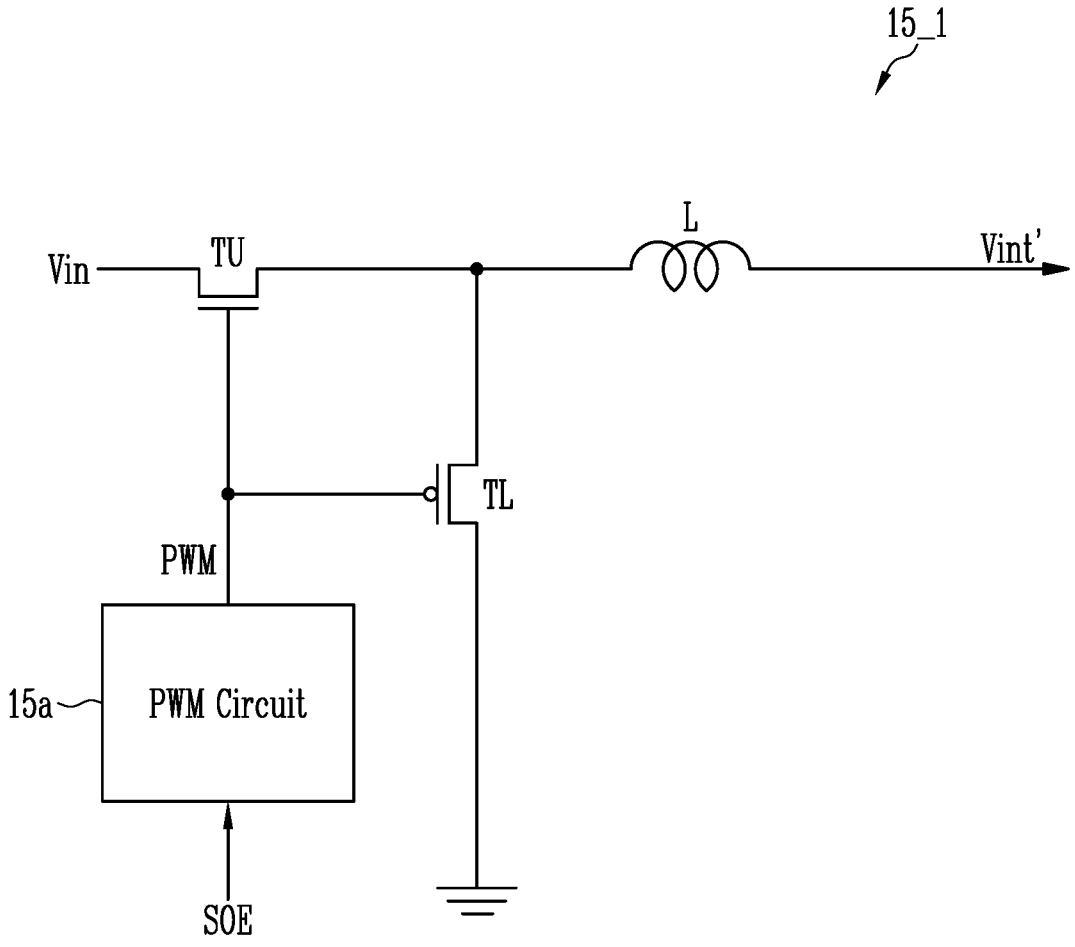
FIGS. 5A and 5B are diagrams for explaining embodiments of a DC-DC converter included in a reference voltage controller of FIG. 1A.
Figure 5B:
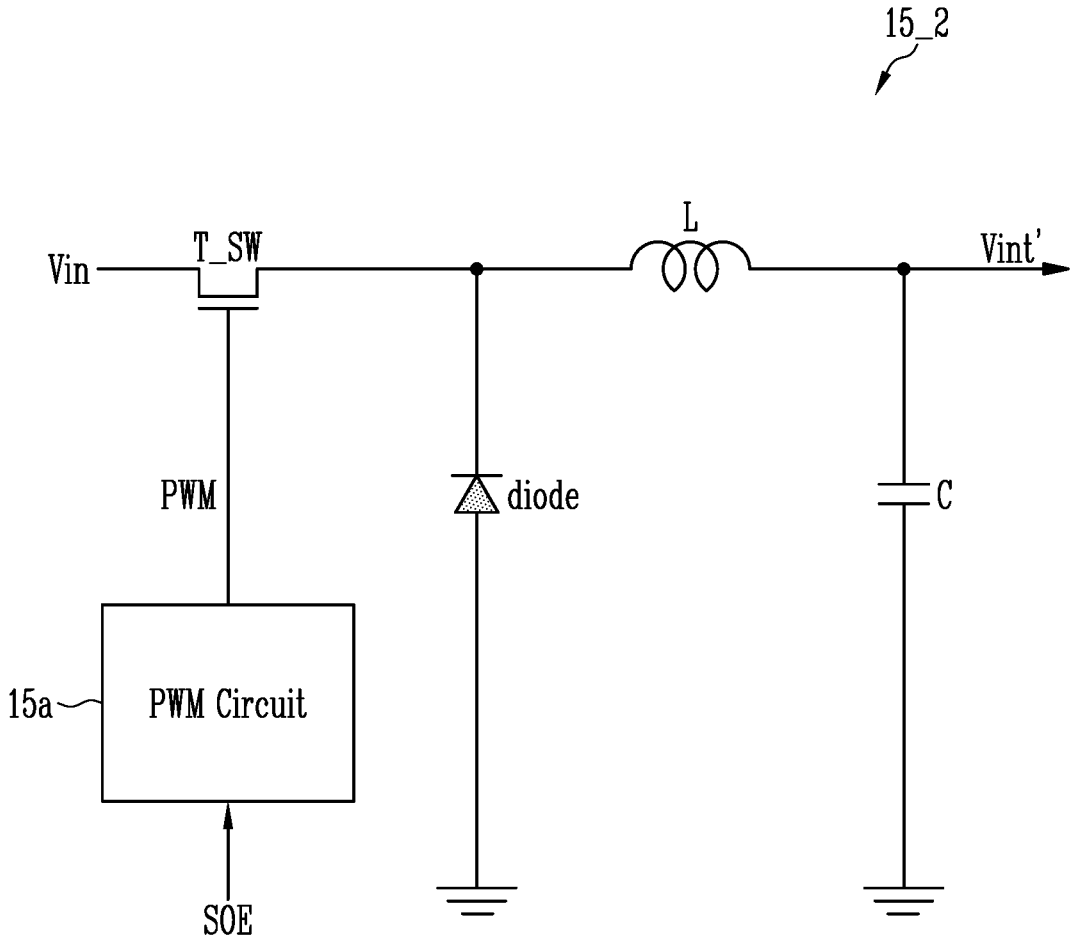
Figure 6:
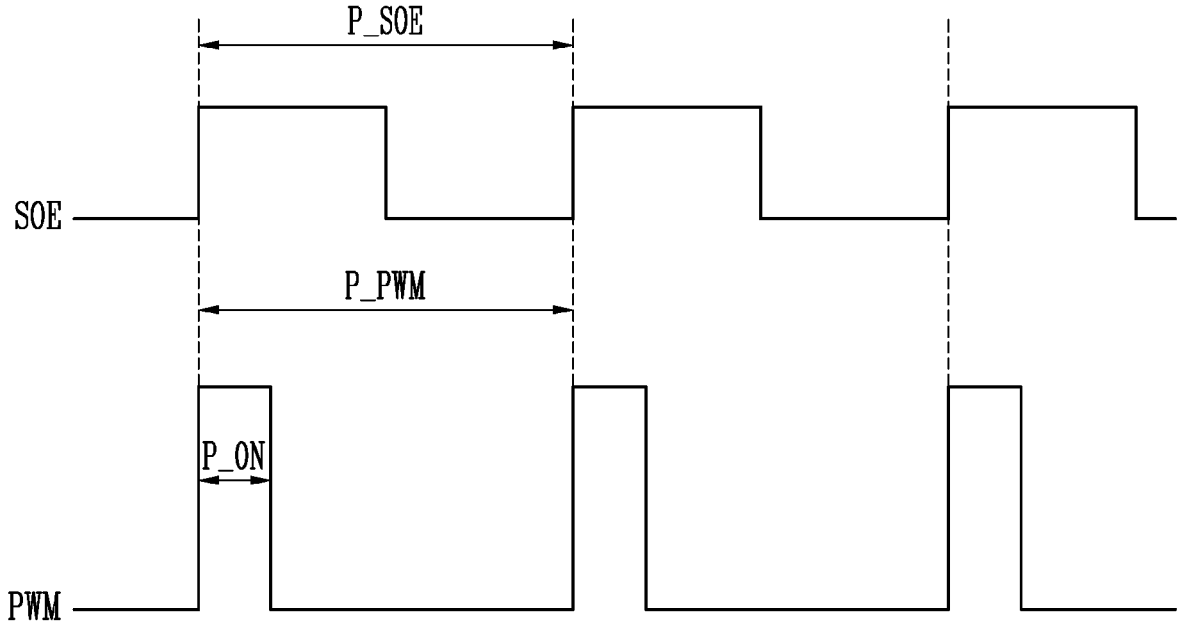
FIG. 6 is a diagram for explaining a relationship between a source output enable signal and a PWM signal.

FIGS. 5A and 5B are diagrams for explaining embodiments of a DC-DC converter included in a reference voltage controller of FIG. 1A. FIG. 6 is a diagram for explaining a relationship between a source output enable signal and a PWM signal.

Referring to FIG. 5A, a reference voltage controller 15_1 may be a DC-DC converter. For example, the DC-DC converter may be composed of a buck converter. The DC-DC converter may include transistors TU and TL, an inductor L, and a PWM circuit 15*a*.

The PWM circuit 15*a* may generate a PWM signal PWM having a period corresponding to a frequency of the source output enable signal SOE. The PWM signal PWM may have an ON/OFF duty ratio and alternately turn on/off the transistors TL and TU. The duty ratio of the PWM signal PWM may be determined independently of the frequency of the source output enable signal SOE.

First, when the transistor TU is turned on and the transistor TL is turned off, energy may be stored in the inductor L as the current increases in the inductor L. Next, when the transistor TU is turned off and the transistor TL is turned on, the energy in the inductor L may be released as the current in the inductor L decreases. In this case, because an input voltage Vin is separated from an output terminal, a compensated reference voltage Vint' reduced based on only the current flowing from the inductor L may be output. As the duty ratio of the PWM signal PWM decreases, the compensated reference voltage Vint' may further decrease.

In addition, referring to FIG. 5B, a reference voltage controller 15_2 may be a DC-DC converter. The DC-DC converter according to some embodiments of the present invention may be a buck converter including a switching element T_SW, an inductor L, a diode, and a capacitor C. In this case, a PWM circuit 15*a* may generate a PWM signal PWM having a period corresponding to the frequency of the source output enable signal SOE. The PWM signal PWM may have an ON/OFF duty ratio and may turn on/off the switching element T_SW. Because the operation method is substantially the same as that of the buck converter shown in FIG. 5A, duplicate descriptions thereof may be omitted.

FIGS. 5A and 5B have been described with reference to the buck converter, but embodiments according to the present invention are not limited thereto. According to some embodiments, various known converters such as a boost converter, a buck-boost converter in which a buck converter and a boost converter are integrated, a Cuk converter, a forward converter, and a flyback converter may be employed as the DC-DC converter.

Referring to FIGS. 1A, 5A, 5B, and 6, the frequency of the source output enable signal SOE may be determined to have a period P_SOE. The PWM signal PWM may have a period P_PWM corresponding to the frequency of the source output enable signal SOE. For example, the PWM circuit 15*a* may be configured such that the period P_PWM of the PWM signal PWM is the same as the period P_SOE of the source output enable signal SOE. In another example, the PWM circuit 15*a* may be configured such that the period P_PWM of the PWM signal PWM is an integer multiple or a fractional multiple of the period P_SOE of the source output enable signal SOE.

The PWM signal PWM may have the duty ratio. The duty ratio may mean a ratio of an on time P_ON in one period P_PWM of the PWM signal PWM. That is, the longer the on time P_ON, the higher the duty ratio may be.

The magnitude of a reference voltage Vint output from the DC-DC converter may depend on the duty ratio of the PWM signal PWM and may not depend on the period P_PWM of the PWM signal PWM.

Figure 7A:
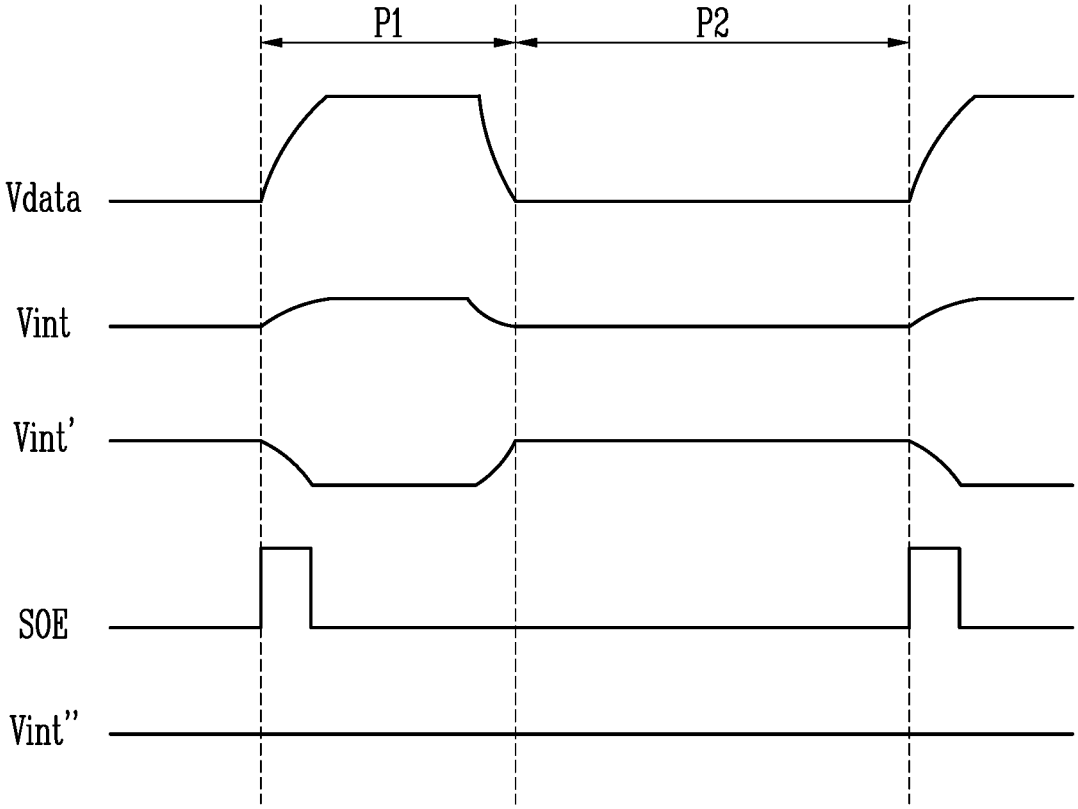
FIGS. 7A and 7B are diagrams for explaining an effect of the present invention.
Figure 7B:
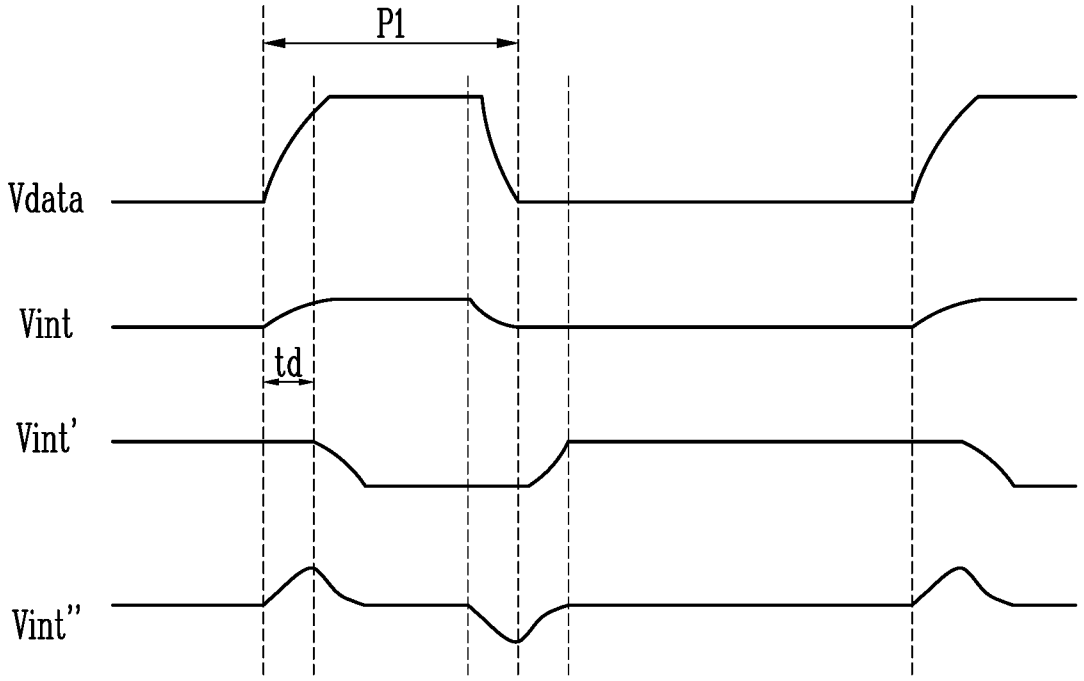

FIGS. 7A and 7B are diagrams for explaining an effect of the present invention.

Referring to FIGS. 1A, 5A, 5B, and 7A, the data driver 12 may receive the source output enable signal SOE from the timing controller 11. The data driver 12 may output a data voltage Vdata (or a data signal) in synchronization with the rising edge of the source output enable signal SOE. A voltage level of the reference voltage Vint may be changed by coupling in a first period P1 in which the data voltage Vdata is changed from a data voltage corresponding to the peak black gray level to an image data voltage having a gray level value (e.g., a set or predetermined gray level value) for every one horizontal period (or in units of pixel rows). For example, in the first period P1 in which the data voltage Vdata is changed from the data voltage corresponding to the peak black gray level to the image data voltage having a 128 gray level value, the voltage level of the reference voltage Vint may be increased in response to the image data voltage. In this case, the reference voltage controller 15 may receive the source output enable signal SOE from the timing controller 11 (or the data driver 12). As shown in FIGS. 5A and 5B, when the reference voltage controller 15 is composed of the buck DC-DC converter, the PWM circuit 15*a* may output the PWM signal PWM in synchronization with the rising edge of the source output enable signal SOE. In this case, the duty ratio of the PWM signal PWM may be set so that the compensated reference voltage Vint' has a voltage level that offsets the voltage level of the reference voltage Vint expected to be increased by coupling. The magnitude of the reference voltage Vint expected to be increased by coupling may be proportional to the amount of change in the data voltage Vdata. For example, when the data voltage Vdata is changed from the data voltage corresponding to the peak black gray level to the data voltage corresponding to the peak white gray level, the voltage level of the reference voltage Vint may be changed (that is, increased) the most.

According to some embodiments of the present invention, the reference voltage controller 15 may calculate the compensated reference voltage Vint' by compensating the reference voltage Vint based on a value (e.g., a set or predetermined value). For example, the value (e.g., the set or predetermined value) may be a value corresponding to the image data voltage according to an intermediate gray level value or a value corresponding to the image data voltage according to a maximum gray level value.

According to some embodiments of the present invention, the reference voltage controller 15 may calculate the compensated reference voltage Vint' by compensating the reference voltage Vint based on a lookup table. In this case, the lookup table may include the duty ratio of the PWM signal PWM corresponding to image data voltages according to a plurality of gray level values. When the reference voltage controller 15 is composed of the buck converter shown in FIGS. 5A and 5B, the duty ratio of the PWM signal PWM may gradually decrease from the duty ratio of the PWM signal PWM corresponding to the data voltage according to a low gray level to the duty ratio of the PWM signal PWM corresponding to the data voltage according to a high gray level.

When the data voltage Vdata and the compensated reference voltage Vint' are simultaneously (or concurrently) output based on the rising edge of the source output enable signal SOE, compensation for a change in the reference voltage Vint due to coupling may be performed without delay. For this reason, a voltage level of a reference voltage Vint" finally supplied to the anode electrode (that is, the second node N2) of the light emitting element LD shown in FIG. 2 may be constantly maintained without change even in the first period P1 in which the data voltage Vdata is changed from the data voltage corresponding to the peak black gray level to the image data voltage having the gray level value (e.g., the predetermined gray level value). Accordingly, an effect in which the pixel Pxij can accurately express a desired gray level can be expected.

On the other hand, unlike the embodiments shown in FIG. 7A in which the data voltage Vdata and the compensated reference voltage Vint' are simultaneously (or concurrently) output based on the rising edge of the source output enable signal SOE, as shown in FIG. 7B, when the compensated reference voltage Vint' is output with a delay of a certain time td from the output of the data voltage Vdata, the increase in the voltage level generated in the reference voltage Vint may not be completely offset by the compensated reference voltage Vint'. For this reason, the voltage level of the reference voltage Vint" finally supplied to the anode electrode (that is, the second node N2) of the light emitting element LD shown in FIG. 2 may include ripples before and after the period P1 in which the data voltage Vdata is changed from the data voltage corresponding to the peak black gray level to the image data voltage having the gray level value (e.g., the predetermined gray level value). In this case, a problem in that the pixel PXij cannot accurately express a desired gray level may occur.

Hereinafter, further details according to some embodiments will be described. In the following embodiments, descriptions of the same components as those of the above-described embodiments may be omitted or simplified, and differences will be mainly described.

Figure 8:
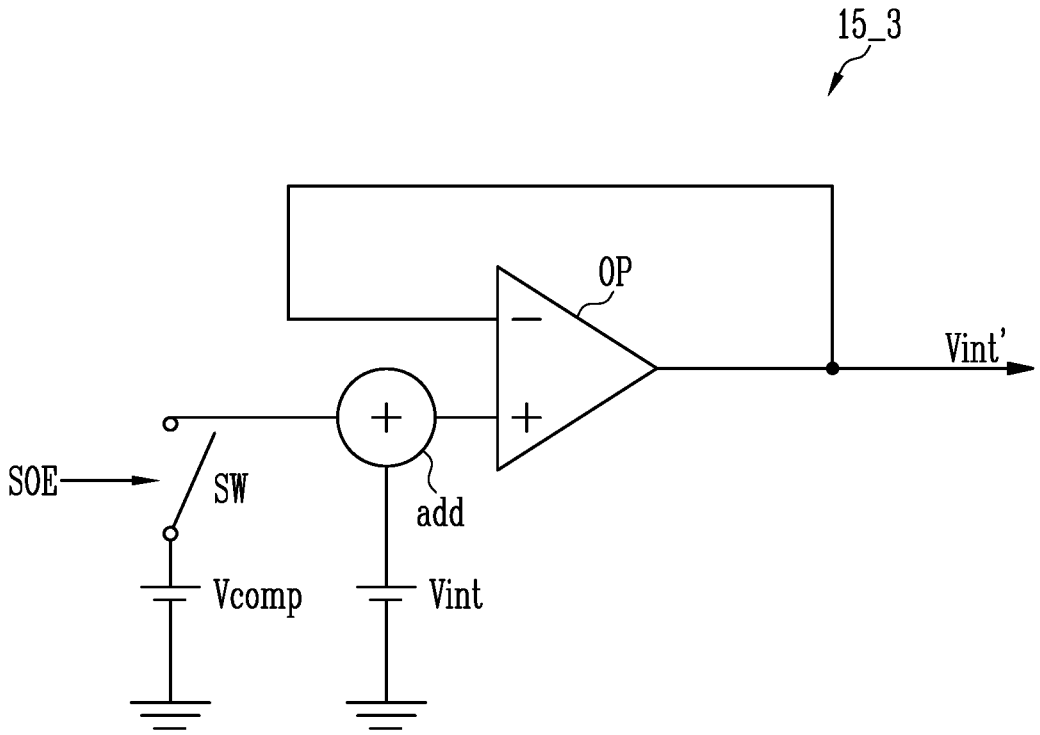
FIG. 8 is a diagram schematically illustrating a reference voltage controller according to some embodiments.

FIG. 8 is a diagram schematically illustrating a reference voltage controller according to some embodiments.

In the embodiments shown in FIGS. 5A and 5B, the reference voltage controller may be composed of the DC-DC converter. However, in the embodiments shown in FIG. 8, there is a difference in that a reference voltage controller 15_3 may be composed of a buffer circuit.

For example, the reference voltage controller 15_3 may be composed of a buffer circuit. The buffer circuit may include an amplifier op, an adder add, and a switch sw.

An inverting terminal (−) of the amplifier op may be connected to an output terminal. The adder add may be connected to a non-inverting terminal (+) of the amplifier op. The adder add may be connected to a reference voltage supply unit supplying a reference voltage Vint and a compensation voltage supply unit supplying a compensation voltage Vcomp. The switch sw may be located between the compensation voltage Vcomp and the adder add. The switch sw may be turned on in response to a source output enable signal SOE.

Referring to FIGS. 1A, 7A, and 8, the data driver 12 may receive the source output enable signal SOE from the timing controller 11. The data driver 12 may output the data voltage Vdata (or the data signal) in synchronization with the rising edge of the source output enable signal SOE. In this case, the voltage level of the reference voltage Vint before compensation may be changed by coupling in a period in which the data voltage Vdata is changed from the data voltage corresponding to the peak black gray level to the image data voltage having the gray level value (e.g., the predetermined gray level value). For example, in a period in which the data voltage Vdata is changed to the image data voltage having a 128 gray level value corresponding to the peak black gray level, the voltage level of the reference voltage Vint may increase in response to the image data voltage.

The reference voltage controller 15_3 according to some embodiments may receive the source output enable signal SOE from the timing controller 11 (or the data driver 12). As shown in FIG. 8, when the reference voltage controller 15 is composed of a buffer circuit, the switch sw may be turned on in synchronization with the rising edge of the source output enable signal SOE. In this case, the compensation voltage Vcomp according to some embodiments may be set so that the compensated reference voltage Vint' has a voltage level that offsets the voltage level of the reference voltage Vint expected to be increased by coupling.

For example, when a target reference voltage Vint is 1 [V] and the reference voltage Vint which is expected to be increased by coupling in the first period P1 in which the data voltage Vdata is changed from the data voltage corresponding to the peak black gray level to the image data voltage having the gray level value (e.g., the predetermined gray level value), is 1.2 [V], the compensation voltage Vcomp may be −0.2 [V] in the first period P1. Accordingly, the compensated reference voltage Vint' may be 0.8 [V] in the first period P1 and 1 [V] in the remaining period P2.

According to some embodiments of the present invention, the reference voltage controller 15 may calculate the compensated reference voltage Vint' by compensating the reference voltage Vint based on a value (e.g., a set or predetermined value). For example, the value (e.g., the set or predetermined value) may be a value corresponding to the image data voltage according to an intermediate gray level value or a value corresponding to the image data voltage according to a maximum gray level value.

According to some embodiments of the present invention, the reference voltage controller 15 may calculate the compensated reference voltage Vint' by compensating the reference voltage Vint based on a lookup table. In this case, the lookup table may include a plurality of compensation voltages Vcomp corresponding to image data voltages according to a plurality of gray level values. An absolute value of the magnitude of the compensation voltage Vcomp may gradually increase from the compensation voltage Vcomp corresponding to the data voltage according to a low gray level to the compensation voltage Vcomp corresponding to the data voltage according to a high gray level.

When the data voltage Vdata and the compensated reference voltage Vint' are simultaneously (or concurrently) output based on the rising edge of the source output enable signal SOE, compensation for a change in the reference voltage Vint due to coupling can be applied without delay. For this reason, a voltage level of a reference voltage Vint" finally supplied to the anode electrode (that is, the second node N2) of the light emitting element LD shown in FIG. 2 may be constantly maintained without change even in the period in which the data voltage Vdata is changed from the data voltage corresponding to the peak black gray level to the image data voltage having the gray level value (e.g., the set or predetermined gray level value). Accordingly, an effect in which the pixel Pxij can relatively accurately express a desired gray level can be achieved.

The display device according to some embodiments of the present invention may compensate for the change in the voltage level of the reference voltage generated by coupling without delay. Accordingly, the generation of ripples may be prevented or reduced, so that a desired gray level can be relatively accurately expressed.

The drawings referred to heretofore and the detailed description of the invention described above are merely illustrative of the invention. It is to be understood that the invention has been disclosed for illustrative purposes only and is not intended to limit the meaning or scope of the invention as set forth in the claims. Therefore, those skilled in the art will appreciate that various modifications and equivalent embodiments are possible without departing from the scope of the invention. Accordingly, the true technical protection scope of the invention should be determined by the technical idea of the appended claims, and their equivalents.

What is claimed is:

1. A display device comprising:

a pixel unit including a plurality of pixels;

a data driver configured to supply a data voltage to the pixels through data lines based on a source output enable signal; and a reference voltage controller configured to supply a reference voltage to the pixels through reference voltage lines, wherein each of the pixels includes a light emitting element between a first power source line and a second power source line, and wherein the reference voltage controller is configured to compensate for the reference voltage based on the source output enable signal, and to supply a compensated reference voltage to an anode electrode of the light emitting element.

2. The display device of claim 1, wherein the data driver is configured to supply the data voltage to the pixels in synchronization with a rising edge of the source output enable signal, and wherein the reference voltage controller is configured to compensate the reference voltage in synchronization with the rising edge of the source output enable signal.

3. The display device of claim 1, wherein the data lines and the reference voltage lines connected to the same pixel among the pixels extend in a first direction on the pixel unit and are adjacent to each other in a second direction crossing the first direction.

4. The display device of claim 1, wherein a voltage level of the reference voltage is changed in response to an image data voltage in a period in which the data voltage is changed from a data voltage corresponding to a peak black gray level to the image data voltage having a predetermined gray level value.

5. The display device of claim 4, wherein the reference voltage controller is configured to compensate the compensated reference voltage to have a voltage level that offsets a changed voltage level of the reference voltage.

6. The display device of claim 4, further comprising:

a timing controller configured to supply a source sampling clock, a source start pulse, and the source output enable signal to the data driver based on image data and timing signals output from a host system.

7. The display device of claim 6, further comprising:

an image pattern analyzer configured to supply a mode conversion signal to the timing controller in response to a predetermined specific image pattern being detected by analyzing the image data.

8. The display device of claim 7, wherein the specific image pattern is an image in which a peak white gray level is displayed on odd-numbered lines and the peak black gray level is displayed on even-numbered lines.

9. The display device of claim 6, wherein the data driver includes:

a shift register configured to receive the source sampling clock and the source start pulse from the timing controller and to sequentially output a plurality of sampling pulses;

a sampling latch configured to sequentially store the image data in response to the sampling pulses sequentially supplied from the shift register; and a holding latch configured to receive and store the image data from the sampling latch in response to receiving the source output enable signal.

10. The display device of claim 9, further comprising:

a decoder configured to convert the image data from the holding latch into an analog signal and to generate a converted analog signal as the data voltage; and a buffer amplifier configured to supply the data voltage received from the decoder to a data line.

11. The display device of claim 9, wherein the reference voltage controller is a buck DC-DC converter including a PWM circuit connected to a gate electrode of at least one transistor, and wherein the PWM circuit is configured to output a PWM signal in synchronization with a rising edge of the source output enable signal.

12. The display device of claim 11, wherein a duty ratio of the PWM signal is set so that the compensated reference voltage has the voltage level that offsets the changed voltage level of the reference voltage.

13. The display device of claim 12, wherein the reference voltage controller is configured to calculate the compensated reference voltage based on a lookup table including the duty ratio of the PWM signal corresponding to image data voltages according to a plurality of gray level values.

14. The display device of claim 13, wherein the duty ratio of the PWM signal gradually decreases from the duty ratio of the PWM signal corresponding to the image data voltage according to a low gray level to the duty ratio of the PWM signal corresponding to the image data voltage according to a high gray level.

15. The display device of claim 9, wherein the reference voltage controller is a buffer circuit including an amplifier, an adder, and a switch, wherein an inverting terminal of the amplifier is connected to an output terminal, and a non-inverting terminal of the amplifier is connected to the adder, wherein the adder is connected to a reference voltage supply unit supplying the reference voltage and a compensation voltage supply unit supplying a compensation voltage, wherein the switch is connected between the adder and the compensation voltage supply unit; and wherein the switch is configured to be turned on in synchronization with a rising edge of the source output enable signal.

16. The display device of claim 15, wherein the compensation voltage is set so that the compensated reference voltage has the voltage level that offsets the changed voltage level of the reference voltage.

17. The display device of claim 16, wherein the reference voltage controller is configured to calculate the compensated reference voltage based on a lookup table including the compensation voltage corresponding to image data voltages according to a plurality of gray level values.

18. The display device of claim 17, wherein an absolute value of the compensation voltage gradually increases from the compensation voltage corresponding to the image data voltage according to a low gray level to the compensation voltage corresponding to the image data voltage according to a high gray level.

19. The display device of claim 6, further comprising:

a scan driver configured to receive gate control signals from the timing controller and to supply scan signals to first scan lines and second scan lines in the pixel unit.

20. The display device of claim 19, wherein each of the pixels includes:

a first transistor including one electrode connected to the first power source line, a gate electrode connected to a first node, and the other electrode connected to a second node;

a second transistor including one electrode connected to the data line, the other electrode connected to the first node, and a gate electrode connected to a first scan line;

a third transistor including one electrode connected to the second node, the other electrode connected to a reference voltage line, and a gate electrode connected to a second scan line;

a storage capacitor connected between the first node and the second node; and the light emitting element connected between the second node and the second power source line.

* * * * *